US006568117B2

(12) United States Patent
Weinraub

(10) Patent No.: US 6,568,117 B2
(45) Date of Patent: May 27, 2003

(54) GUN HAMMER AND LEVER LOCK

(75) Inventor: Adam S. Weinraub, Orange, CA (US)

(73) Assignee: Weinraub Enterprises, Inc., Orange, CA (US)

( * ) Notice: Subject to any disclaimer, the term of this patent is extended or adjusted under 35 U.S.C. 154(b) by 0 days.

(21) Appl. No.: 10/029,689

(22) Filed: Dec. 20, 2001

(65) Prior Publication Data

US 2002/0178634 A1 Dec. 5, 2002

Related U.S. Application Data

(63) Continuation-in-part of application No. 09/871,753, filed on Jun. 1, 2001, now Pat. No. 6,457,272.

(51) Int. Cl.[7] ..... F41A 17/26
(52) U.S. Cl. ..... 42/70.11; 42/70.07; 42/70.08
(58) Field of Search ..... 42/70.07, 70.08, 42/70.11

(56) References Cited

U.S. PATENT DOCUMENTS

| | | | | | |
|---|---|---|---|---|---|
| 3,624,945 | A | | 12/1971 | Foote | |
| 3,956,842 | A | | 5/1976 | Ballenger | |
| 4,030,221 | A | | 6/1977 | Doobenen et al. | |
| 4,299,045 | A | * | 11/1981 | Cervantes | 42/70.11 |
| 4,392,318 | A | * | 7/1983 | Daniels | 42/70.11 |
| 4,395,837 | A | * | 8/1983 | Durnal | 42/70.08 |
| 4,499,681 | A | | 2/1985 | Bako et al. | |
| 4,509,281 | A | | 4/1985 | Dreiling et al. | |
| 4,624,372 | A | * | 11/1986 | Brolin | 211/4 |
| 4,813,252 | A | * | 3/1989 | Ray | 70/18 |
| 4,934,083 | A | * | 6/1990 | Smith | 42/70.07 |
| 5,153,360 | A | | 10/1992 | Upton | |
| 5,191,158 | A | | 3/1993 | Fuller et al. | |
| 5,437,119 | A | | 8/1995 | Womack | |
| 5,680,723 | A | * | 10/1997 | Ruiz | 42/70.11 |

FOREIGN PATENT DOCUMENTS

| | | | | |
|---|---|---|---|---|
| AT | 117 | * | 8/1899 | 42/70.07 |
| DK | 70 800 | * | 3/1950 | 42/70.07 |
| DK | 72 894 | * | 8/1951 | 42/70.07 |

OTHER PUBLICATIONS

American Rifleman; Gunloc Security Device; p. 18; Jan./Feb. 1995.*

One page flyer illustrating a cable lock arrangement for guns; Project Homesafe; no date.

* cited by examiner

*Primary Examiner*—Stephen M. Johnson
(74) *Attorney, Agent, or Firm*—Harold L. Jackson

(57) ABSTRACT

An firearm lock arrangement for immobilizing the hammer of a gun is disclosed including a side bracket having a upper portion that attaches over the top of a gun with a plug that extends into the space between the hammer and the firing pin to block the hammer from striking the firing pin. The side bracket may be locked to the gun trigger guard by a conventional padlock or cooperative locking side members.

5 Claims, 4 Drawing Sheets

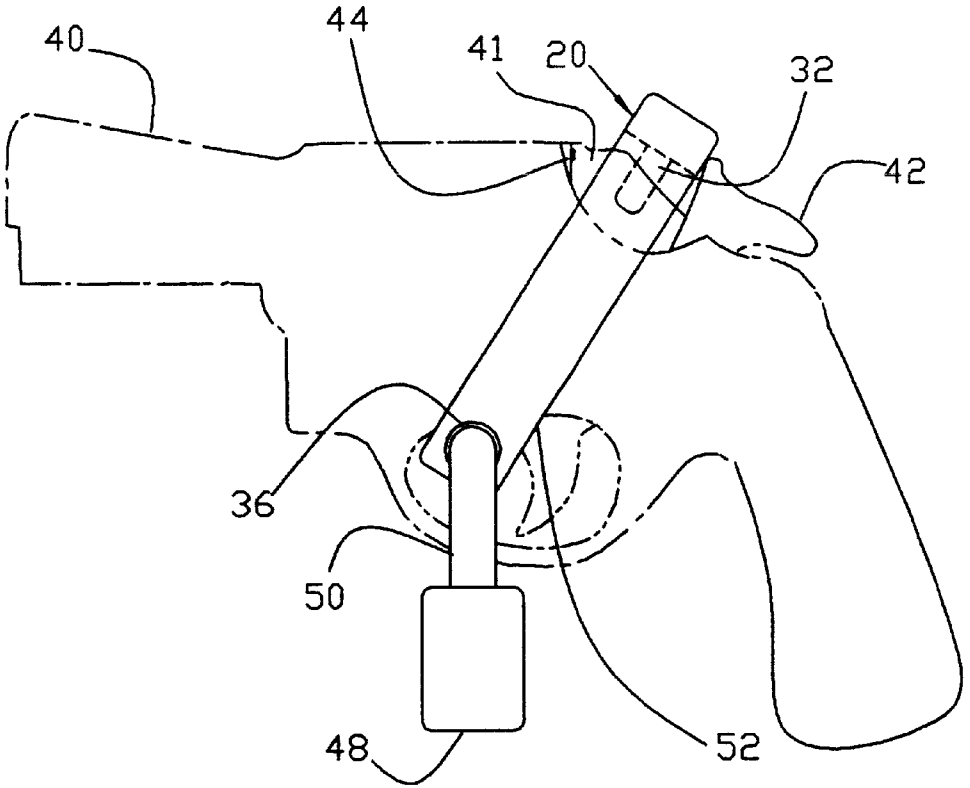
Fig. 3
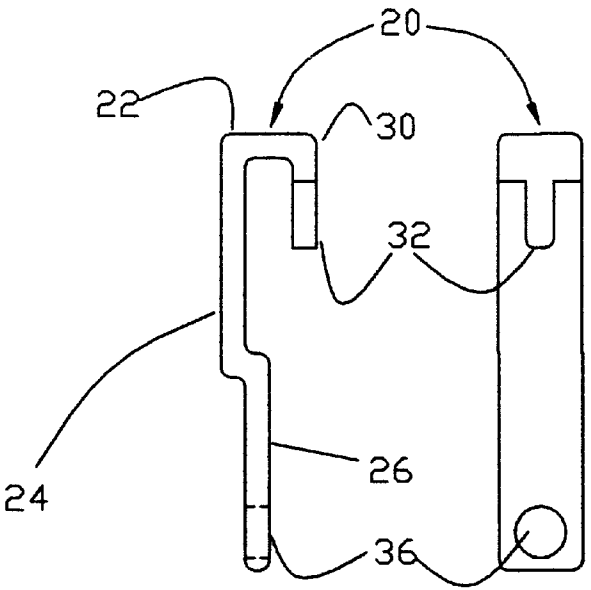
Fig. 2
Fig. 1

GUN HAMMER AND LEVER LOCK

RELATED APPLICATION

This application is a continuation-in-part of application Ser. No. 09/871,753, filed Jun. 1, 2001 now U.S. Pat No. 6,457,272 entitled FIREARM SECURITY ARRANGEMENT.

FIELD OF THE INVENTION

This invention relates generally to firearm safety lock devices, and more particularly, to gun locks for immobilizing the hammer and/or actuating lever of a gun.

BACKGROUND OF THE INVENTION

Thousand of handguns and rifles are purchased every year by citizens for use in sporting events, such as hunting and target shooting, or for use in home protection. Typically, guns are stored at one's home or apartment in drawers, closets or even under the bed. While a minority of gun owners have gun safes to store their guns, most guns owners store their guns in unlocked areas of the home accessible to others dwelling there. As such, guns provide a danger to children or adolescents whose curiosity may lead them to find and play with a gun. Additionally, a child finding a firearm may take it to show friends or take it to school. While adults may believe that guns are safely put away, children and adolescents always seem to find them, and as a result, fatalities and injuries resulting from the accidental discharge of firearms, particularly by children, has become problematic. Also the intentional use of guns by children against classmates and teachers in schools has been increasing over the last several years. Suicides by use of firearms are also at an alarming rate. In response to the rise of this danger, the U.S. Congress and many state legislative bodies throughout the country have enacted or are in the process of enacting legislation requiring that each new purchase of a gun be accompanied by the purchase of a suitable lock. Additionally, states are creating strict requirements that gun locks must pass to resist tampering and attacks that could disable or remove a gun lock. This is in part a response to the large number of commercially available locks that are of poor quality and unreliable.

Conventional gun locking devices typically have two sides which clamp around the trigger guard of the gun to prevent access to the trigger, such as the devices shown in U.S. Pat. No. 5,191,158 "Trigger Guard for a Firearm", U.S. Pat. No. 4,499,681 "Security Device for Firearms", U.S. Pat. No. 4,509,281 "Gun Trigger Lock", U.S. Pat. No. 3,956,842 "Gun Trigger Lock", and U.S. Pat. No. 3,624,945 "Universal Self-Conforming Trigger Lock for Firearms". Other conventional gun locking devices are designed to immobilize the trigger as illustrated in U.S. Pat. No. 5,153,360 "Gun Lock". Some gun lock devices have been developed without key locking arrangements to allow quick access to the gun by adults but rendered safe against children who may gain access to the gun, such as disclosed in U.S. Pat. No. 4,030,221 "Gun Lock Using Manual Pressure" and U.S. Pat. No. 5,437,119 "Gun Trigger Blocking Structure" assigned to the assignee of the present invention.

These gun locks, while attempting to prevent access to the gun trigger, leave the gun hammer exposed and unsecured. Accordingly, the gun hammer in many cases can still be manipulated and gun may still be fired. A reliable gun locking arrangement that deters tampering with a gun hammer would be an advancement in the gun locking art. It would further be an advantage in the art to provide a gun locking device that includes a mechanism to prevent manipulation of the cocking lever on lever action rifles. Effective gun locks will save lives of the individuals who may tamper with a gun or the life of a person from accidental or intentional use. The present invention provides such improved firearm security arrangements.

SUMMARY OF THE INVENTION

It is therefore an object of this invention to provide gun lock arrangements that prevent access to a gun when the gun is not in use.

Another object of the invention is to provide a gun hammer lock arrangement that deters tampering with the hammer of a gun.

A further object of the invention is to provide a gun lock arrangement for securing the actuating lever of a lever action gun/rifle.

Still another object is to provide gun security arrangements that are resistant to tampering by children and adolescents, protecting them from injury to themselves or others.

The invention provides a gun locking apparatus for preventing unauthorized use of a firearm comprising a side bracket adapted to be mounted on one side of a gun, the side bracket having a plug extending into an open area between the hammer and firing pin formed when the hammer is urged into an open position. The plug blocks the hammer from striking the firing pin. Alternatively, instead of the plug, the bracket may include a upper section that extends over the top of the gun and captures and immobilizes the hammer. The bracket may be affixed to the gun by a locking mechanism, such as a padlock or other conventional locking devices.

In order to further enhance the gun locking apparatus, the side bracket may include a bottom portion that seats under the bottom of a gun trigger guard or gun lever action. The side bracket may also be hardened, or hardened inserts may be added to the bracket, to provide additional security.

The construction and operation of preferred embodiments of such above-described gun lock arrangements of the present invention may best be understood by reference to the following description taken in conjunction with the accompanying drawings in which like components are designated by the same reference numbers.

BRIEF DESCRIPTION OF DRAWINGS

FIG. 1 is a front view of a gun hammer lock side bracket;

FIG. 2 is a side view of the side bracket shown in FIG. 1;

FIG. 3 is a side view of the side bracket secured on handgun revolver by means of a pad lock;

DESCRIPTION OF THE PREFERRED EMBODIMENTS

Figure 6:
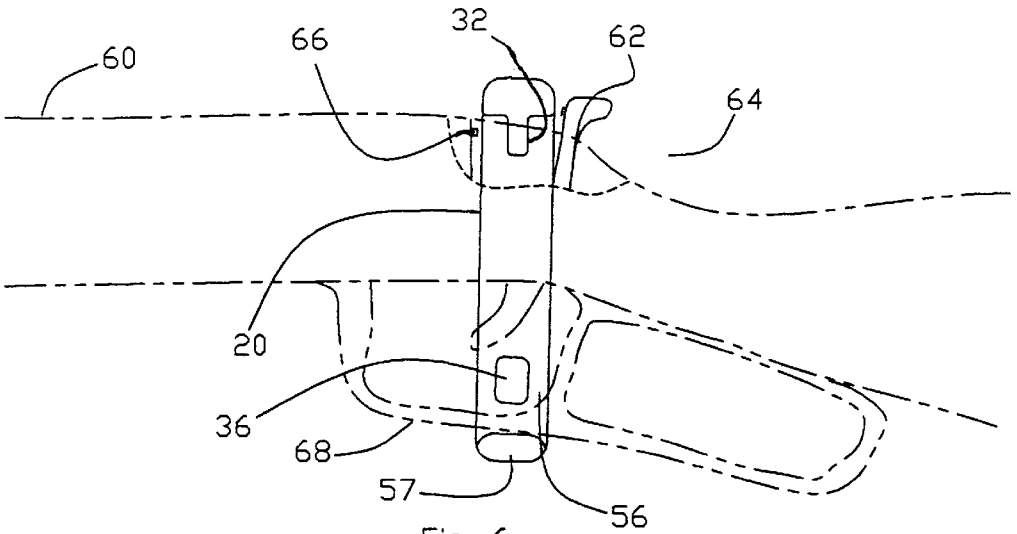
FIG. 6 is a side view of the side bracket of FIG. 4 secured on a lever action rifle.

Referring initially to the drawings and more particularity to FIGS. 1 and 2, there is shown a gun hammer lock arrangement that includes in its most basic form a side bracket 20 having an upper portion 22, a middle portion 24 and a lower portion 26. The upper portion 22 includes means for immobilizing a gun hammer that, in this embodiment, comprises a depending portion 30 having a plug 32. Plug 32 is preferably sized and shaped to seat in the cavity between the firing pin of a gun and the gun hammer when the hammer is urged in an open position. The lower portion 26 may have a hole 36 for receiving a locking mechanism. The middle portion 24 is preferably shaped to follow the contour of the outer shape of the side of the gun. The side bracket 20 is preferably made of a flat metal plate material that may be hardened to resist cutting or other tampering.

In use, as shown in FIG. 3, the side bracket 20 is coupled to a gun 40 (shown in phantom) by inserting the plug 32 into the cavity 41 between the hammer 42 and the firing pin 44 when the hammer is pulled rearwardly. The plug 32 is prevented from engaging the firing pin by the contact between the upper portion 22 of the bracket and the frame of the gun. The side bracket 20 extends downwardly along the outer side surface of the gun and is locked to the gun by a lock mechanism such as padlock 48, inserted through the hole 36 in the lower portion 26 of the side bracket 20. The distance between the hole 36 (and the shackle 50 of the padlock) and the plug may be selected such that the shackle seats under the bottom surface 52 of the gun when the plug is seated in the cavity 41, thus deterring removal of the gun hammer lock.

Figure 5:
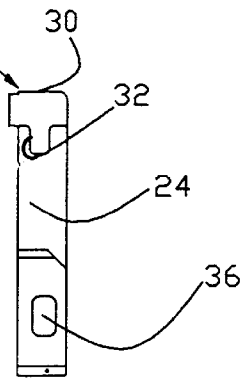
FIG. 5 is a side view of the side bracket shown in FIG. 4.
Figure 4:
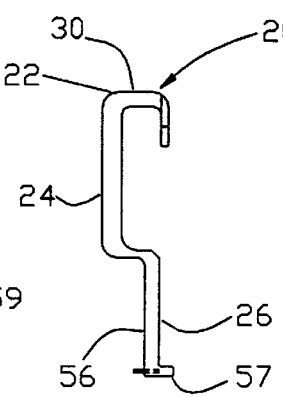
FIG. 4 is a front view of another gun hammer lock side bracket.
Figure 4A:
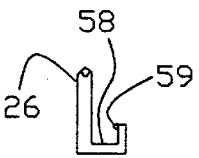
FIG. 4*a* is a partial front view of the gun hammer lock side bracket of FIG. 4 showing an alternate configuration of the side bracket lower portion.
Figure 7:
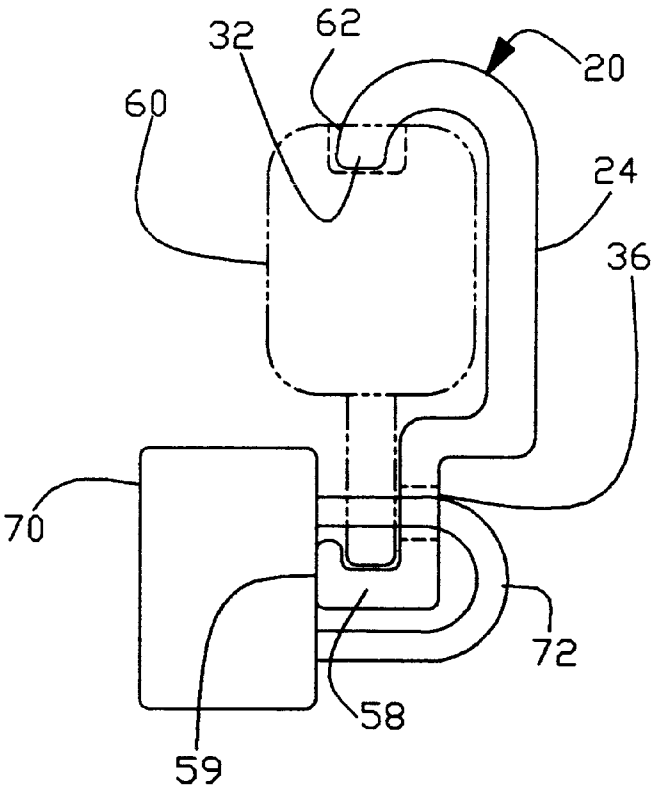
FIG. 7 is a front view of the side bracket shown in FIG. 6 pad locked to the lever action rifle.

The lower portion 26 of the side bracket 20 may additionally include means for securing the side bracket 20 to a trigger guard such as illustrated in FIGS. 4 and 5. An L-shaped portion 56 is added to the lower portion 26 of the bracket 20, this L-shaped portion having a depending leg 57. Alternatively, the lower portion 26 may have a U-shaped or channel portion 58 with upstanding portion 59 which is sized and shaped to receive a trigger guard. The bracket 20 is placed on a gun such as a lever action rifle 60, shown in phantom in FIG. 6. The plug 32 of the bracket sits in the cavity 62 between the hammer 64 and the firing pin 66, and the depending leg 57 seats under the trigger guard/actuating lever 68 preferably in contact with the bottom of the trigger guard. This bracket 20 may be secured to the gun by conventional locking mechanisms such as a padlock 70 as illustrated in FIG. 7. The padlock shackle 72 is inserted through the trigger guard/actuating lever 68 and the hole 36 in the lower portion 26 of the bracket 20.

Figure 8:
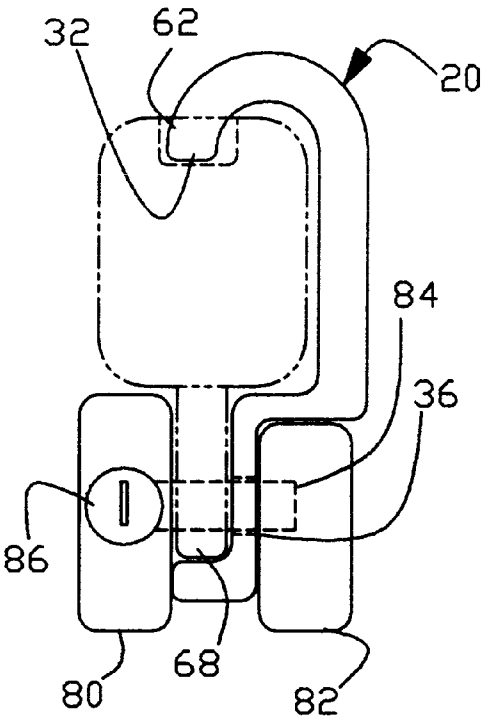
FIG. 8 is front view of the side bracket shown in FIG. 6 secured to the lever action rifle by means of side blocks.

Alternatively, the bracket may be secured to the gun by trigger guard/actuating lever lock arrangements as illustrated in FIG. 8. Two side members 80 and 82 mounted on each side of the trigger guard 68 and locked together by means of latch pin 84. The latch pin 84 from side member 80 extends through the trigger guard 68 and the hole 36 in the bracket 20 and into the other side member 82 wherein it is latched by a key lock mechanism 86. Upon assembly, the L-shaped portion depending leg 57 limits the upward movement of the bracket 20 keeping the plug 32 in place in the cavity 62 of the gun. The side members can cover the trigger and trigger guard, blocking access to thereto and providing additional security of the gun lock. An example of the above-described side member arrangement is described in detail in Applicant's co-pending patent application identified above, which application is incorporated herein by reference.

Figure 9:
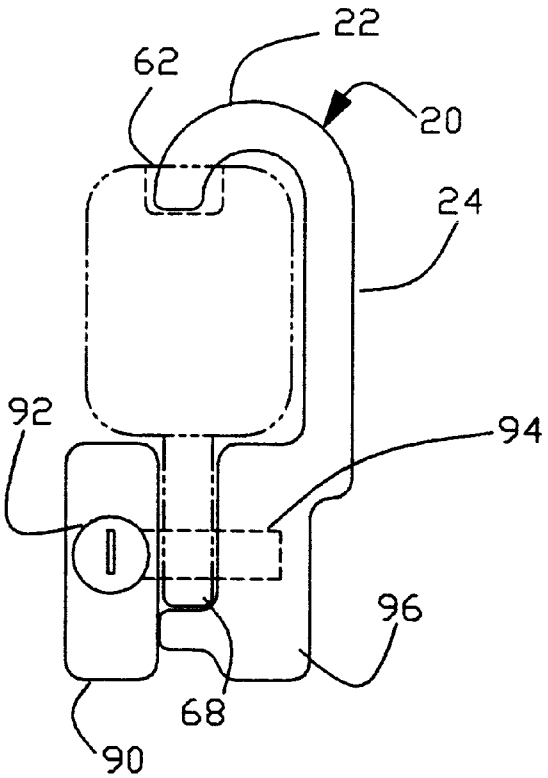
FIG. 9 is front view of the side bracket side integrally formed with a locking mechanism.

In a further embodiment, the bracket can also be made as an integral part of one of the side members as shown in FIG. 9. In this embodiment, one side member 90 may have a lock and key arrangement 92 which captures a latch pin 94 extending from the other side member 96, thereby holding the two side members together about the trigger guard and trigger. The middle and upper portions of the side bracket 20 extend upwardly from the side member 96. When assembled, the side bracket 20 extends along the outside of the gun and the plug 32 into the gun receiver cavity.

Figures 10, 11:
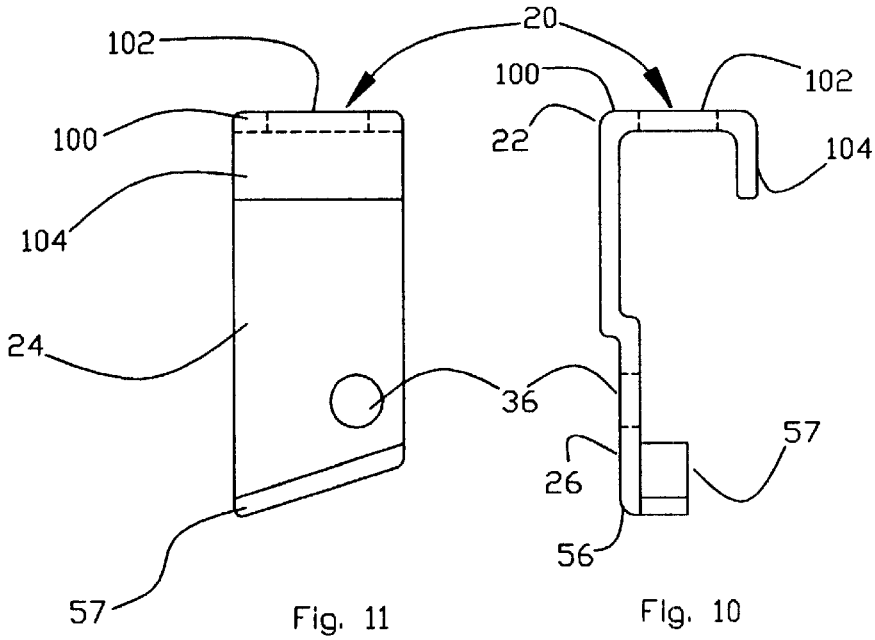
FIG. 10 is a front view of another gun hammer lock side bracket.
FIG. 11 is a side view of the side bracket shown in FIG. 10.
Figure 12:
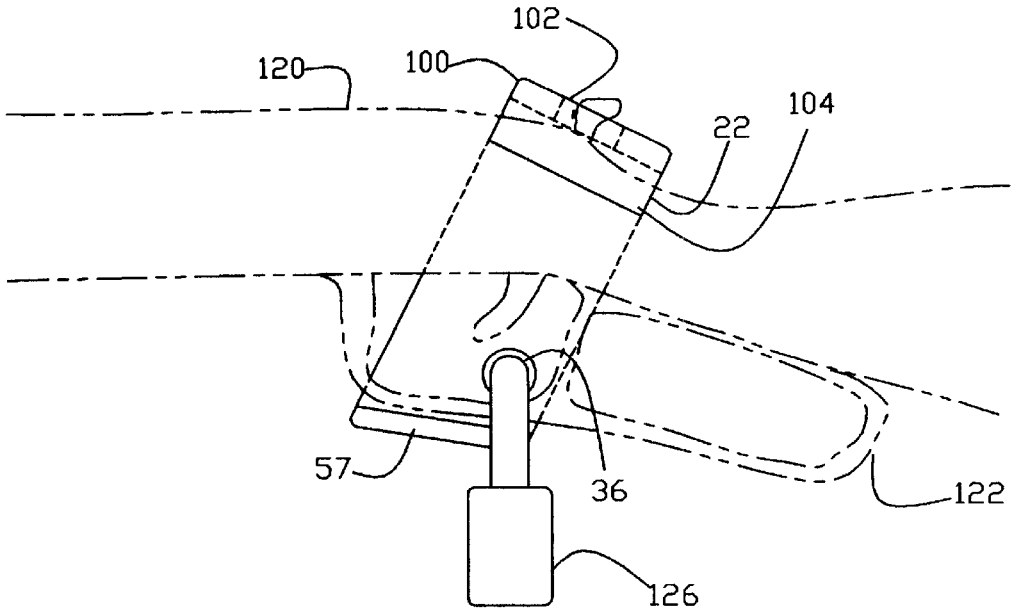
FIG. 12 is a side view of the side bracket of FIG. 10 secured on a lever action rifle.

FIGS. 10 and 11 illustrate another embodiment of the gun hammer lock side bracket. In this embodiment the upper portion 22 of the side bracket 20 has a top depending portion 100 having an opening 102. The depending portion 100 terminates in a downwardly depending portion 104. The lower portion may include the L-shaped portion 56 with its depending leg 57. The opening 102 is sized and shaped to receive a gun hammer. As shown in FIG. 12, the side bracket 20 is assembled to a lever action gun 120 (shown in phantom) with the top depending portion 100 seating on top of the gun with the hammer contained in the opening 102. The lower portion depending leg 57 seats under the lever action 122. The side bracket upper portion depending leg limits the movement of the lever action, such as cocking of the firearm. Movement of the hammer is limited within opening 102. The side bracket 20 may be locked to the lever action by a padlock 126 inserted through hole 36, or other means such as coupled side members as described hereinabove.

A side bracket with a lower portion that provides a simple lever action locking arrangement is a further embodiment of the invention. More specifically, side bracket with a lower L-shaped portion 56 with depending leg, or a lower portion with U-shaped channel portion 58 as described above may by affixed to a gun by a locking mechanism such that the actuating lever is secured in a closed position. The bracket may further include an upper portion which extends over the top of the gun to seat thereon when the bracket is in place. The upper portion when seated on the top of the gun prevents downward movement of the side bracket. This side bracket may be affixed to the gun by opposed lockable side members that sandwich the bracket and the actuating lever there-between. In this embodiment the upper portion of the side bracket need not extend between the hammer and firing pin or otherwise block the hammer. A bracket which locks the actuating lever in its closed or upper position will deter the unauthorized use of a lever action rifle.

The various embodiments of the side bracket may be made of metallic material and further may be strengthened by hardening or adding hardened inserts as more particularly described in the previously identified co-pending application.

There has thus been described a variety of firearm security arrangements. In today's environment more reliable and secure locks are needed for guns to prevent access by children or other unauthorized users. These firearm security arrangements also deter and resist physical efforts to steal a firearm. Various modifications to these firearm security arrangements will occur to persons skilled in the art without involving any departure from the spirit and scope of the invention as set forth in the appended claims.

What is claimed is:

1. A gun lever action locking arrangement for a lever action gun having a trigger and an actuating lever, comprising:

a side bracket having an upper and a lower section, the side bracket adapted to be mounted on a side of the gun and the actuating lever with the side bracket lower section having a depending edge which seats under the actuating lever, the upper section having a depending portion which seats over the top of the gun with an opening for capturing the hammer of the gun when the lower section depending edge seats under the actuating level; and means for affixing the side bracket to the gun such that the bracket lower section secures the actuating lever in a closed position.

2. The gun lever action locking arrangement defined in claim 1 wherein the bracket is hardened.

3. The gun trigger blocking apparatus defined in claim 1 wherein the side bracket is locked to the gun by a padlock.

4. The gun trigger blocking apparatus defined in claim 3 wherein the side bracket is hardened.

5. The gun hammer locking apparatus defined in claim 4 wherein the side member is made of hardened metallic material.

* * * * *